US012023740B2

(12) United States Patent
Kronberger et al.

(10) Patent No.: US 12,023,740 B2
(45) Date of Patent: Jul. 2, 2024

(54) DEVICE FOR PRODUCING A GEAR GREEN COMPACT

(71) Applicant: Miba Sinter Austria GmbH, Laakirchen (AT)

(72) Inventors: Christian Kronberger, Vorchdorf (AT); Horst Roessler, Krenglbach (AT); Martin Ohler, Vorchdorf (AT); Alexander Mueller, Altmuenster (AT)

(73) Assignee: Miba Sinter Austria Gmbh, Laakirchen (AT)

( * ) Notice: Subject to any disclaimer, the term of this patent is extended or adjusted under 35 U.S.C. 154(b) by 417 days.

(21) Appl. No.: 17/583,298

(22) Filed: Jan. 25, 2022

(65) Prior Publication Data

US 2022/0281002 A1 Sep. 8, 2022

(30) Foreign Application Priority Data

Mar. 5, 2021 (AT) ..... A 50160/2021

(51) Int. Cl.
*B22F 5/00* (2006.01)
*B22F 3/16* (2006.01)
*B22F 5/08* (2006.01)

(52) U.S. Cl.
CPC ..... *B22F 5/085* (2013.01); *B22F 3/164* (2013.01); *B22F 2998/00* (2013.01)

(58) Field of Classification Search
CPC ..... B22F 3/02; B22F 3/03; B22F 5/08; B22F 5/085; B22F 9/10; B22F 2003/031; B22F 2003/033
See application file for complete search history.

(56) References Cited

U.S. PATENT DOCUMENTS

| | | | | |
|---|---|---|---|---|
| 3,327,548 | A * | 6/1967 | Welch | F16H 55/0806 74/462 |
| 5,012,691 | A * | 5/1991 | Bertot | B29C 45/44 74/DIG. 10 |
| 5,366,363 | A * | 11/1994 | Good | B30B 11/04 425/418 |
| 6,165,400 | A * | 12/2000 | Hinzmann | B30B 11/02 264/318 |
| 11,480,239 | B2 * | 10/2022 | Bankovic | B22F 3/03 |
| 2009/0101104 | A1 * | 4/2009 | Baasch | F02D 11/106 123/399 |
| 2012/0118104 | A1 | 5/2012 | Gurosik et al. | |
| 2020/0217408 | A1 | 7/2020 | Bankovic et al. | |

FOREIGN PATENT DOCUMENTS

| | | |
|---|---|---|
| DE | 23 21 939 B2 | 9/1980 |
| DE | 20 2020 100 041 U1 | 3/2020 |
| GB | 1 399 852 A | 7/1975 |

* cited by examiner

*Primary Examiner* — Thu Khanh T. Nguyen
(74) *Attorney, Agent, or Firm* — Collard & Roe, P.C.

(57) ABSTRACT

A device for producing a gear green compact from a powder includes a die, an upper stamp, and a lower stamp, wherein the die has at least one helical toothing on an inner lateral surface, which helical toothing extends only over a partial area of the circumference of the inner lateral surface, and which has a first helix angle, wherein, adjoining the first helical toothing in a circumferential direction, one toothed edge surface is formed on each side, both of which have a second helix angle, wherein at least one of the second helix angles of the die is unequal to the first helix angle of the helical toothing of the die.

15 Claims, 5 Drawing Sheets

DEVICE FOR PRODUCING A GEAR GREEN COMPACT

CROSS REFERENCE TO RELATED APPLICATIONS

Applicant claims priority under 35 U.S.C. § 119 of Austrian Application No. A50160/2021 filed Mar. 5, 2021, the disclosure of which is incorporated by reference.

BACKGROUND OF THE INVENTION

1. Field of the Invention

The invention relates to a device for producing a gear green compact made of a metallic powder, comprising a die for receiving the metallic powder, an upper stamp and a lower stamp, which are designed such that they can be immersed in the die, wherein on an inner lateral surface, the die has at least one helical toothing, which extends only over a partial area of the circumference of the inner lateral surface and which has a first helix angle, wherein, adjoining the first helical toothing in the circumferential direction, one toothed edge surface is formed on each side, which both have a second helix angle, wherein on an outer lower stamp lateral surface, the lower stamp has a lower stamp helical toothing, which extends only over a partial area of the circumference of the lower stamp lateral surface, and which has the first helix angle of the die, wherein, adjoining the helical toothing in the circumferential direction, one toothed edge surface is formed on each side, which both have a third helix angle, wherein on an outer upper stamp lateral surface, the upper stamp has an upper stamp helical toothing, which extends only over a partial area of the circumference of the upper stamp lateral surface, and which has the first helix angle of the helical toothing, wherein, adjoining the helical toothing in the circumferential direction, one toothed edge surface is formed on each side, which both have a fourth helix angle.

The invention further relates to a method for producing a sintered gear comprising the steps: providing a metallic powder; compacting the powder to form a gear green compact; possibly green machining the gear green compact; sintering the gear green compact.

Additionally, the invention relates to a sintered gear comprising a gear body, which has a lateral surface and two end faces, wherein at least one helical toothing is arranged on the lateral surface, which helical toothing extends only over a partial area of the circumference of the gear body and which has a first helix angle, and wherein, adjoining the helical toothing in the circumferential direction, one toothed edge surface is formed on each side, which both extend at a second helix angle relative to the axial direction.

2. Description of the Related Art

Sector gears are already known from the prior art. For example, gears of this kind, in which the toothing is located only in the region of a sector of the circumference, are used for a variety of actuators.

A sector gear with helical toothing and produced in a powder-metallurgical manner is also already known from the prior art. Accordingly, DE 20 2020 100 041 U1 describes a helical sector gear comprising: a sector gear body, which is disposed about a central axis; and a gear segment which is coupled to the sector gear body and extends radially therefrom, wherein the gear segment has a plurality of helical teeth, wherein the gear segment has a first spacing segment, a second spacing segment and a toothed sector that is disposed circumferentially between the first and second spacing segments and on which all of the helical teeth are formed, wherein each of the helical teeth extends over a predetermined width of the gear segment and has a root that is spaced radially from the central axis by a predetermined root dimension, wherein the first spacing segment consists of a first helical land having a first circumferential surface and a first radial surface, wherein the first circumferential surface extends radially from the central axis by a first dimension and the first radial surface extends radially between the sector gear body and the first circumferential surface, wherein the first radial surface has a first helical contour that conforms to a helix angle of the helical teeth, and wherein the second spacing segment consists of a second helical land having a second circumferential surface and a second radial surface, wherein the second circumferential surface extends radially from the central axis by a second dimension, and wherein the second radial surface extends radially between the sector gear body and the second circumferential surface, wherein the second radial surface has a second helical contour that conforms to the helix angle of the helical teeth.

SUMMARY OF THE INVENTION

The underlying object of the present invention is to improve the powder-metallurgical producibility of a sector gear.

In case of the initially mentioned device, the object is achieved in that at least one of the second helix angles of the die is unequal to the first helix angle of the helical toothing of the die.

Moreover, the object of the invention is achieved by means of the initially mentioned method in which the compacting of the powder to form a gear green compact is carried out in a device according to the invention for producing a gear green compact.

Additionally, the object of the invention is achieved by means of the initially mentioned sintered gear, for which it is provided that the second helix angle of at least one of the toothed edge surfaces is unequal to the first helix angle of the helical toothing.

In this regard, it is advantageous that, by arranging at least one of the toothed edge surfaces at a helix angle that is different from the helix angle of the helical toothing, the localized tool load, in particular the load on the die, can be changed and adjusted due to the "redistribution" to other surfaces of the tool. Consequently, chippings of tools can be better prevented, whereby the service life of the tool can be increased.

For further improving this effect, it may be provided according to embodiment variants of the invention that the second helix angle is unequal to the first helix angle by a value amounting to between 0.005° and 0.05°, and/or that the difference between the second helix angle and the first helix angle has a value which is calculated according to the formula INV SIN (RA/H), wherein RA refers to the maximum radial distance between the die and the lower stamp or upper stamp and H is the height of the die, in each case given in mm.

According to a different embodiment variant of the invention, it may be provided that at least one of the third helix angles of the lower stamp and/or at least one of the fourth helix angles of the upper stamp is unequal to the first helix angle of the helical toothing of the die, whereby the load distribution within the tool can be calibrated better.

In this regard, it may also be provided according to embodiment variants for further improving this effect that the third helix angle of the lower stamp and/or the fourth helix angle of the upper stamp is unequal to the first helix angle by a value amounting to between 0.005° and 0.05°, and/or that the difference between the third helix angle of the lower stamp and the first helix angle and/or the fourth helix angle of the upper stamp and the first helix angle has a value which is calculated according to the formula INV SIN (RA/H), wherein RA refers to the maximum radial distance between the die and the lower stamp or upper stamp and H is the height of the die, in each case given in mm.

According to the preferred embodiment variant, it may be provided that the second helix angle of the die is smaller than the first helix angle of the helical toothing. Thus, the load can partially be distributed from the toothed edge surface onto the toothing itself, whereby the load of a relatively large surface can be divided and thus, chippings of tools can be prevented better. With this embodiment variant, it can particularly be achieved that the upper stamp rests on the die in the lower region of the die (as viewed across the height). This has the advantage that the superjacent material of the die (as viewed across the height of the die) supports this contact region and breakage of tools can be better prevented.

Also for a better support, it may be provided according to a further embodiment variant of the invention that the third helix angle of the lower stamp and/or the fourth helix angle of the upper stamp is or are smaller than the first helix angle of the helical toothing.

For a better adjustability of the overall system die-stamp, it may be provided according to a different embodiment variant that the third helix angle of the lower stamp and/or the fourth helix angle of the upper stamp is or are greater than the second helix angle of the die.

According to a different embodiment variant of the invention, it may be provided that the third helix angle of the lower stamp and/or the fourth helix angle of the upper stamp is formed only across a partial area of the height of the toothed edge surface, and that the remaining partial area of the height is formed having at least a helix angle different from the third helix angle of the lower stamp and/or from the fourth helix angle of the upper stamp. By means of the creation of different helix angles (as viewed across the height of the surfaces), on the one hand, the contact surface itself between the die and the stamp can be increased, wherein the helix angle in the second partial area enables a corresponding supporting effect of the contact region by the tool itself.

According to an embodiment variant of the method, it may be provided that the extent of the absolute value of the deviation of the second helix angle of the toothed edge surfaces from the first helix angle of the toothing is selected dependent on a pressure force at which the metallic powder is compacted to form the gear green compact, wherein $(p*S)/100{,}000=\Delta S$ applies, wherein p is the pressure force given in [MPa], S is the first helix angle given in [° ] and ΔS is the deviation from the first helix angle given in [° ]. The tool can thus be better adjusted to the working conditions, whereby the aforementioned effects can be improved further.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings,

FIG. 3 shows a cutout from the device for producing a sintered gear in an oblique view and partially sectional;

DETAILED DESCRIPTION OF PREFERRED EMBODIMENTS

First of all, it is to be noted that in the different embodiments described, equal parts are provided with equal reference numbers and/or equal component designations, where the disclosures contained in the entire description may be analogously transferred to equal parts with equal reference numbers and/or equal component designations. Moreover, the specifications of location, such as at the top, at the bottom, at the side, chosen in the description refer to the directly described and depicted figure and in case of a change of position, these specifications of location are to be analogously transferred to the new position.

Figure 1:
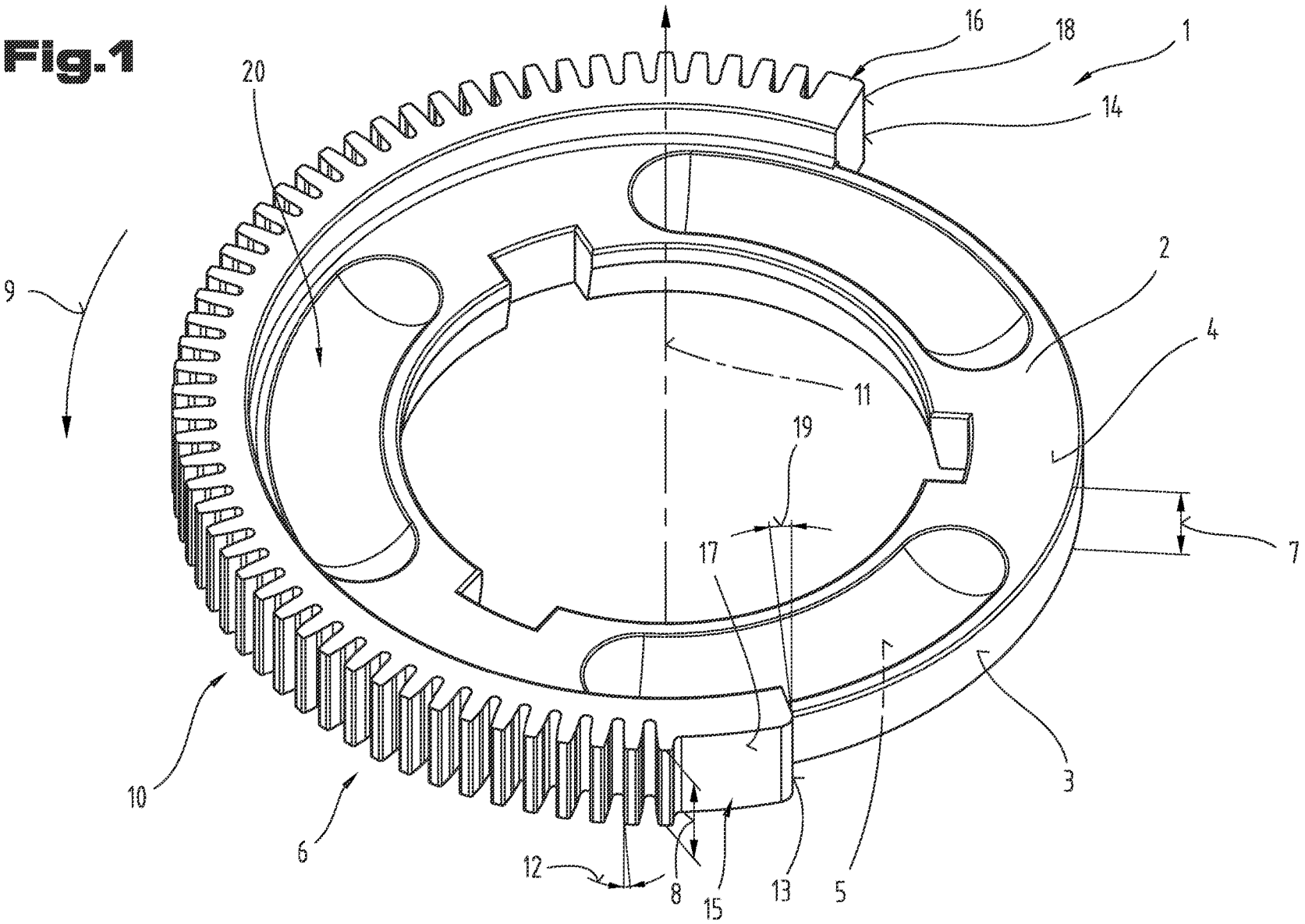
FIG. 1 shows a sintered gear in an oblique view.

FIG. 1 shows an embodiment variant of a sintered gear 1 in an oblique view. The sintered gear 1 comprises a gear body 2. The gear body has an outer lateral surface 3 and two axial end faces 4, 5 and/or is bounded by them. On the lateral surface, at least one helical toothing 6 is arranged and/or formed. The helical toothing 6 is particularly formed in one piece with the gear body 2. The helical toothing 6 may extend in the axial direction across an entire width of the gear body 2 or only a partial area thereof. It is also possible that the helical toothing protrudes beyond the gear body 2 in the axial direction, meaning its width 8 is thus greater than the width 7 of the gear body 2, as it is shown in FIG. 1.

As can be seen in FIG. 1, the helical toothing 6 extends in a circumferential direction 9, not over an entire circumference of the sintered gear 1 and/or of the gear body 2 but only over a partial area thereof. The sintered gear 1 thus has the helical toothing 6 only in a sector, which is why the sintered gear 1 may also be referred to as sector gear.

Although FIG. 1 only shows one helical toothing 6 in a sector, the sintered gear 1 may have multiple helical toothings 6 in the circumferential direction 9, which, however, are spaced apart from one another in the circumferential direction 9. Hence, multiple sectors of the sintered gear 1 may be provided with and/or formed with helical toothings 6.

Merely for the sake of completeness, it should be noted that the helical toothing 6 has teeth 10, which do not extend parallel to the axial direction 11 of the sintered gear 1 but at an angle relative thereto.

The end toothing 6 has a first helix angle 12, which is enclosed by the teeth 10 with the axial direction 11, i.e. at which angle the teeth 10 are inclined against the axial direction 11.

The first helix angle 12 may have a value of between 0.1° and 45°, for example.

The end toothing 6 is bounded by a first toothed edge surface 13 and a second toothed edge surface 14 in the circumferential direction, wherein the end toothing 6 is arranged between these two toothed edge surfaces 13, 14 in the circumferential direction 9. In the embodiment variant of the sintered gear 1 shown in FIG. 1, the toothed edge surface 13 is arranged and/or formed on a web 15 and the toothed edge surface 14 is arranged and/or formed on a web 16, which are, in particular, formed and/or arranged directly adjoining the helical toothing 6. The toothed edge surfaces 13, 14 in the illustrated embodiment variant of the sintered gear 1 are those surfaces of the webs 15, 16 which directly adjoin the lateral surface 3 of the gear body 2.

The toothed edge surfaces 13, 14 may enclose an angle with the lateral surface 3 of the gear body 2, which angle may be between 60° and 300°, in particular between 90° and 135°, wherein these values are not to be considered limiting. In the preferred embodiment variant, the toothed edge surfaces 13, 14 may be arranged so as to stand perpendicular to the lateral surface 3 of the gear body 2.

The web 15 has a plateau surface 17 which, on the one side, preferably directly adjoins the helical toothing 6 and, on the other side, preferably directly adjoins the toothed edge surface 13. The web 16 has a plateau surface 18 which, on the one side, preferably directly adjoins the helical toothing 6 and, on the other side, preferably directly adjoins the toothed edge surface 14. The plateau surfaces 17, 18 may be formed so as to be spaced apart, in the circumferential direction 9, at an equal distance over the entire course from the lateral surface 3 of the gear body 2 (as viewed in the radial direction). However, it is also possible that the webs 15, 16 have a stepped design, so that the plateau surfaces 17, 18 have multiple partial plateau surfaces which have different radial heights above the lateral surface 3 of the gear body 2. Moreover, it may be provided that the plateau surfaces 17, 18 or partial plateau surfaces thereof have an ascending progression in the direction towards the helical toothing 6.

In the case of the formation of at least one stepped web 15, 16, the at least one further toothed edge surface formed thereby may be designed equally to the toothed edge surface 13 or 13, so that the previous embodiments and the following embodiment in this regard may also be applied analogously to the at least one further toothed edge surface. However, it is also possible that this further toothed edge surface is formed having the first helix angle 12 of the helical toothing, meaning it is inclined against the axial direction 11 at this angle.

Moreover, it may be provided that transitions between the lateral surface 3 of the gear body 2 and at least one of or all of the toothed edge surfaces 13, 14 and/or between at least one of the or the toothed edge surfaces 13, 14 and at least one of the or the plateau surfaces 17, 18 and/or between at least one of or all of the plateau surfaces 17, 18 and the helical toothing 6 and/or between further surfaces of at least one of the or the webs 15, 16 are formed in a rounded or beveled manner.

The toothed edge surfaces 13, 14 extend at a second helix angle 19 relative to the axial direction 11. In this regard, it is provided that the second helix angle 19 of at least one of the toothed edge surfaces 13, 14 has a value different from the first helix angle 12 of the helical toothing 6 and is thus unequal to the first helix angle 12. However, it is also possible for both toothed edge surfaces 13, 14 to have the same second helix angle 19 which is unequal to the first helix angle 12. It can moreover be provided that both toothed edge surfaces 13, 14 have a second helix angle 19 that is different from the first helix angle 12, wherein these two second helix angles 19, however, are different from one another. Moreover, it may be provided that one of the two toothed edge surfaces 13, 14 has a second helix angle 19 which is equal to the first helix angle 12, whereas the other one of the two toothed edge surfaces 13, 14 in any case has a second helix angle 19 that is unequal to the first helix angle 12.

The background regarding the second helix angle 19 that is unequal to the first helix angle 12 will be explained in more detail below.

In case the sintered gear 1 has multiple helical toothing sectors, at least those of the two toothed edge surfaces 13, 14 which point in the same direction of rotation have a second helix angle 19 which is unequal to the first helix angle 12, wherein the first helix angles 12 of the helical toothings 6 have the same size. Preferably, the second helix angles 19 of the toothed edge surfaces 13, 14 pointing in the same direction of rotation are also of the same size.

According to a preferred embodiment variant of the sintered gear 1, it may be provided that the second helix angle 19 is unequal to the first helix angle 12 by a value that is between 0.005° and 0.05°.

In the preferred embodiment variant of the sintered gear 1, the second helix angle 19 is and/or the second helix angles 19 are smaller than the first helix angle 12.

For the sake of completeness, it should be noted at this point that all helix angles 12, 19 have the same sign, meaning that the bevels are all provided in the same direction (with consideration of the different helix angles 12, 19).

The sintered gear 1 shown in FIG. 1 is designed as a ball ramp actuator and has three ball ramps 20. This embodiment, however, is not to be considered limiting for the invention. Rather, the specific embodiment of the sintered gear 1 follows the respective intended application.

The production of the sintered gear 1 is carried out according to a powder-metallurgical method. As these methods are known per se, further explanations in this regard may be dispensed with. It should only be mentioned that the powder-metallurgical comprises the providing of a metallic powder, the compacting of the metallic powder to form a gear green compact, possibly green machining the gear green compact, sintering the gear green compact (in one or multiple steps) as well as possibly post-processing the sintered gear 1, for example hardening and/or calibrating.

Figure 2:
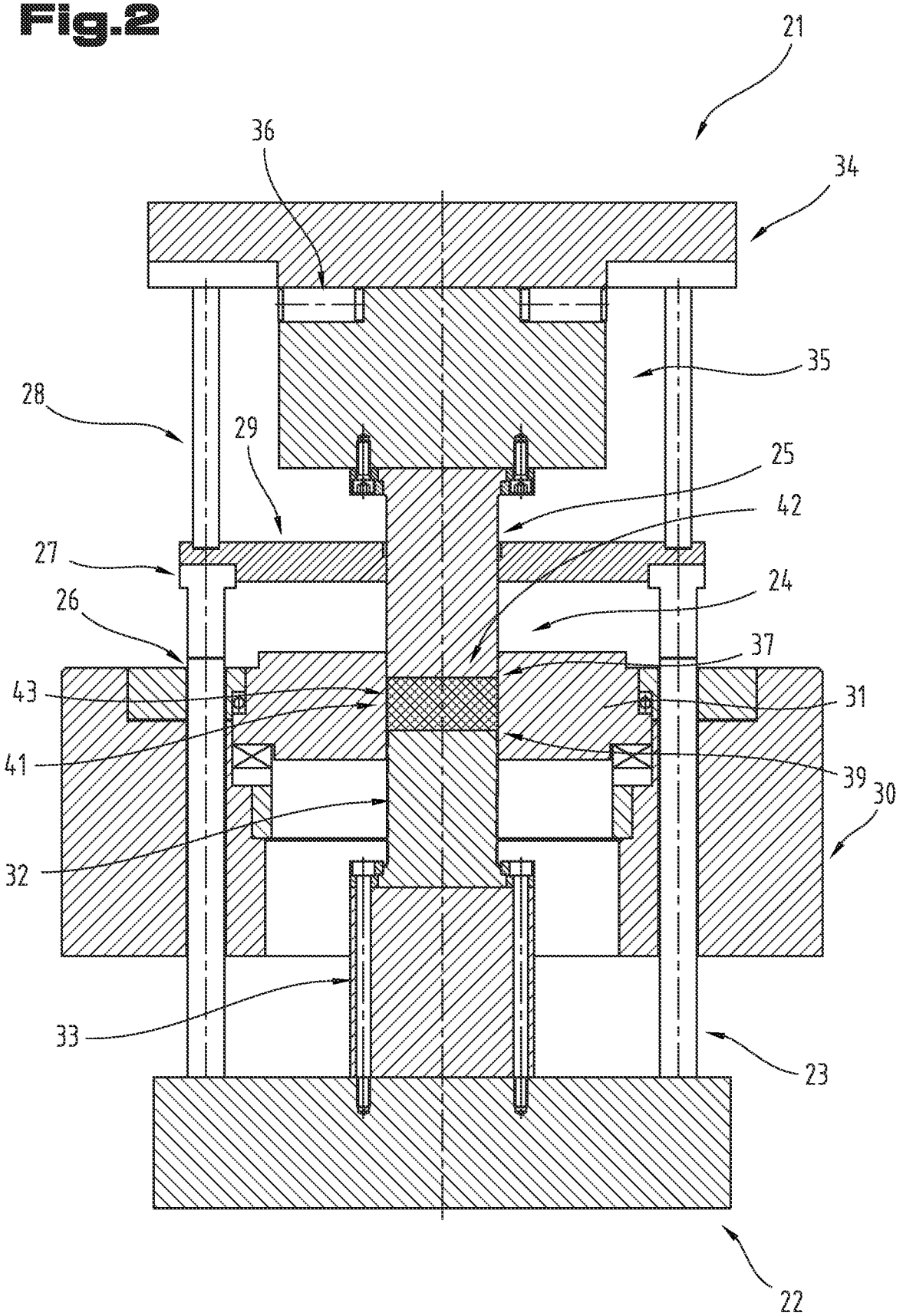
FIG. 2 shows a device for producing a gear green compact in a sectional side view.
Figure 9:
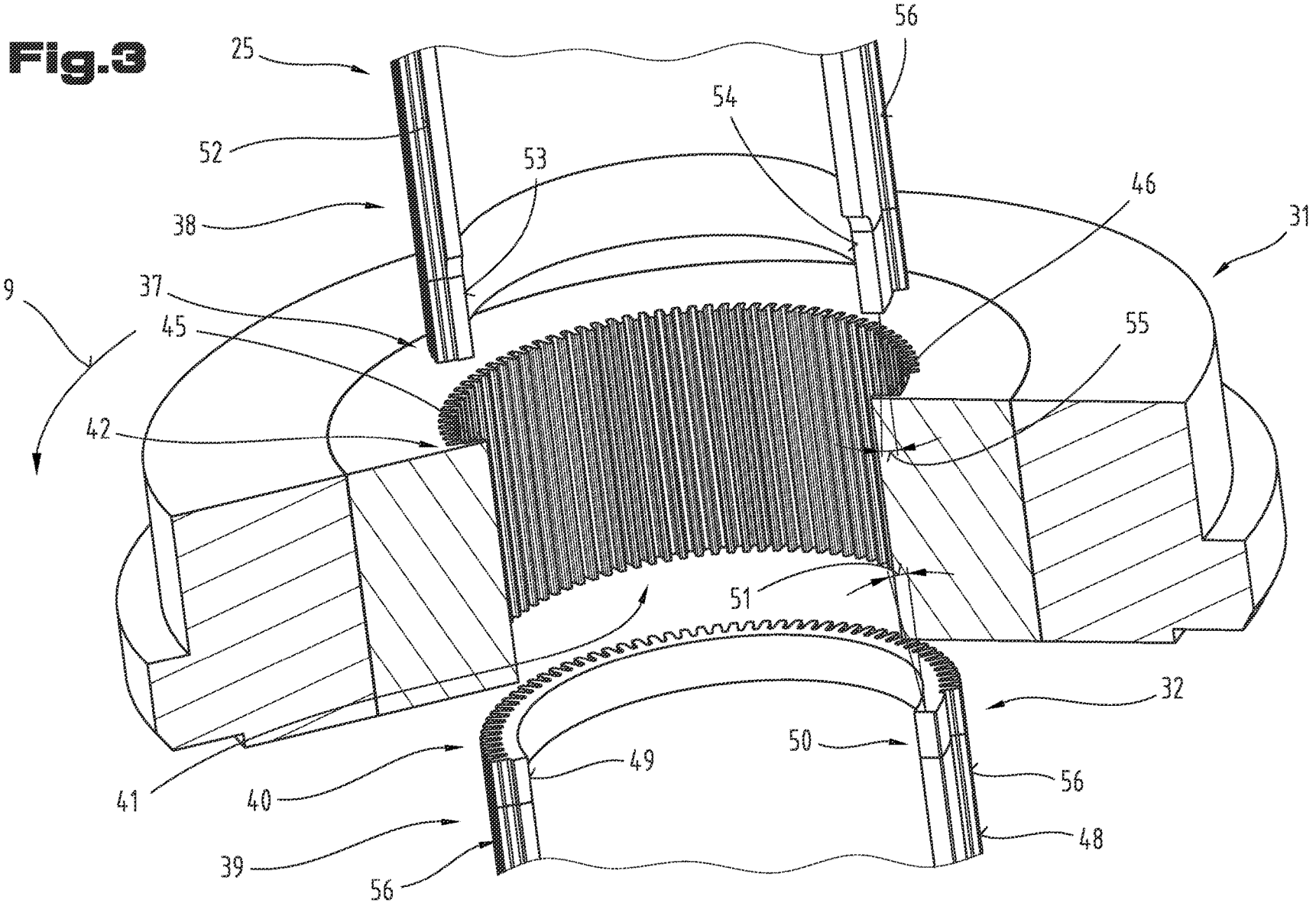

In the method for producing the gear green compact, a device 21 is used, of which an embodiment variant is shown in FIG. 2.

The device 21 comprises a lower stamp receptacle 22 on which columns 23 can rest. The columns 23 may, on the one hand, serve to hold a compacting tool 24 and, on the other hand, to guide the vertical movement of an upper stamp 25. Moreover, the columns 23 may also be used for controlling the movement of the upper stamp 25. For this purpose, the columns 23 in this embodiment variant may comprise four upper stamp rotating elements 26-29. In this process, the maximum vertical displaceability of the upper stamp 25 may be limited by the upper stamp rotating element 27. The upper stamp rotating element 29 may additionally be used for vertically supporting the upper stamp 25 in order to prevent a twisting of the upper stamp rotating element 25. The lower stamp receptacle 22 may, in this regard, form the control level.

Moreover, a die receptacle 30 for a die 31 is supported on these columns 23. In this embodiment variant, a lower stamp 32 is held by a lower stamp support 33, which is supported on the lower stamp receptacle 22.

The upper stamp 25, the die 31, and the lower stamp 32 form the compacting tool 24.

The upper stamp 25 is held by an upper stamp receptacle 34 so as to be vertically displaceable, wherein this upper stamp receptacle 24 is supported on the upper stamp rotating element 28 and is moved up to a stop between the upper stamp rotating element 26 and the upper stamp rotating element 27 during the downward movement of the upper stamp 25 onto said upper stamp rotating element 26, as can be seen in FIG. 2.

Between the upper stamp 25 and the upper stamp receptacle 34, an upper stamp support 35 is arranged, wherein a bearing 36 may be formed and/or arranged at least partially between the upper stamp receptacle 35 and the upper stamp support 34.

In an embodiment variant in this regard, it is possible to replace each of the columns 23 by a single continuous column, wherein, in this case, the upper stamp receptacle 34 is held so as to be displaceable along these continuous columns.

The upper stamp 25 has an upper stamp external toothing 38 at least in an end region 37 pointing to the lower stamp 32, as can be seen better in FIG. 3, which shows the die 31 with the lower stamp 32 and the upper stamp 25.

The lower stamp 32 has a lower stamp external toothing 40 at least in an end region 39 pointing to the upper stamp 25.

The die 31, however, has a die internal toothing 41 in the region of the die opening 42, i.e. on an inner lateral surface of this die opening 42. The die internal toothing 41 is designed to be complementary to the helical toothing 6 of the sintered gear 2 and moreover to be complementary to the upper stamp external toothing 28 of the upper stamp external toothing 25 and to the lower stamp external toothing 40 of the lower stamp 32.

It is possible that the lower stamp 32 and/or the upper stamp 25 each comprise at least one so-called core pin—not shown —, which is/are arranged so as to extend in the axial direction centrally along a central axis in order to form a recess in the sintered gear 1.

For producing a gear green compact 43, a metallic powder is filled into the die 31. In this process, the lower stamp 32 immerses into the die while the upper stamp 25 does not. Afterwards, the closing motion is initiated by means of the vertical lowering of the upper stamp 25, wherein the upper stamp 25 can be made to rotate before hitting the die 31 in order to thus create the precise relative position of the upper stamp external toothing 38 of the upper stamp 25 with the die internal toothing 41 of the die 31, so that the immersion of the upper stamp external toothing 38 of the upper stamp 25 into the die internal toothing 41 of the die 31 is made possible without any problems.

Due to the joint further vertical movement of the upper stamp 25 and the die 31 downwards, they are made to rotate when the lower stamp 32 is at a standstill due to the toothings of the die 31, the lower stamp 32, and the upper stamp 25 being in engagement.

The rotational movement of the upper stamp 25 is stopped after the setting of the synchronous position, meaning that position in which a smooth engagement of the upper stamp external toothing 38 and the die internal toothing 41 of the die 31 is made possible, so that in this phase of the production method, the upper stamp 25 moves exclusively vertically.

After completion of the powder compaction, the gear green compact 43 is ejected and the die 31 and the upper stamp 25 are moved back into their original positions.

Figure 4:
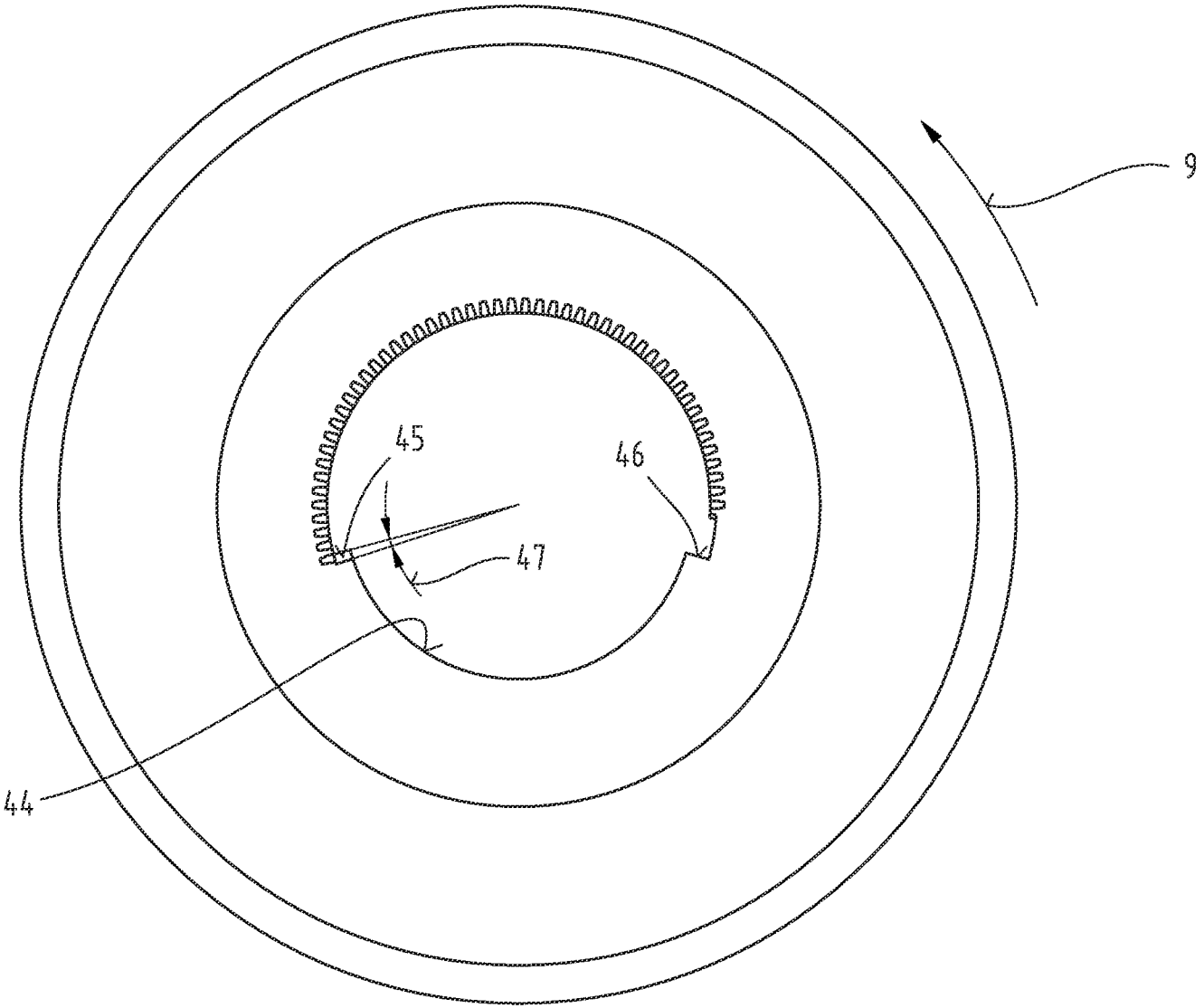
FIG. 4 shows a top view onto a die.

For producing the sintered gear 1, i.e. the gear green compact 43 from which the sintered gear 1 is made, the die internal toothing 41 is designed as a helical toothing which extends only over a partial area of the circumference in the circumferential direction 9 of the inner lateral surface 45, as can be seen better in FIG. 4 as well as FIG. 3. This helical toothing has the first helix angle 12 (FIG. 1) of the helical toothing 6 of the sintered gear 1. The length of the helical toothing in the circumferential direction 9 is equivalent to the length of the helical toothing 6 of the sintered gear 1 in the circumferential direction 9. Adjoining the helical toothing of the die 31 in the circumferential direction 9, one toothed edge surface 45, 46 having a second helix angle 47 is also formed on each side. The helical toothing of the die 31 is formed between these two toothed edge surfaces 45, 46. The toothed edge surfaces 45, 46 are limiting surfaces of webs on the lateral surface 44 of the die 31 for forming the webs 15, 16 (FIG. 1) of the sintered gear 1. Thus, in a top view, the lateral surface 44, i.e. the inner surface of the die 41 bounding the die opening 42, is designed to be complementary to the corresponding outer surface of the sintered gear 1, i.e. The inner surface of the die 41 simulates the outer surface of the sintered gear 1.

Moreover, the lower stamp external toothing 40 of the lower stamp 32 is designed as a helical toothing which extends only over a partial area of the circumference of a lower stamp lateral surface 48, as can be seen in FIG. 3. This helical toothing has the first helix angle 12 (FIG. 1) of the helical toothing 6 of the sintered gear 1 and/or the die 31. The length of the helical toothing of the lower stamp 32 in the circumferential direction 9 is equivalent to the length of the helical toothing 6 of the sintered gear 1 and/or the die 31 in the circumferential direction 9. Adjoining the helical toothing of the lower stamp 32 in the circumferential direction 9, one toothed edge surface 49, 50 having a third helix angle 51 is formed on each side.

Moreover, the upper stamp external toothing 38 of the upper stamp 25 is designed as a helical toothing which extends only over a partial area of the circumference of an upper stamp lateral surface 52, as can be seen in FIG. 3. This helical toothing has the first helix angle 12 (FIG. 1) of the helical toothing 6 of the sintered gear 1 and/or the die 31. The length of the helical toothing of the upper stamp 25 in the circumferential direction 9 is equivalent to the length of the helical toothing 6 of the sintered gear 1 and/or the die 31 in the circumferential direction 9. Adjoining the helical toothing of the lower stamp 25 in the circumferential direction 9, one toothed edge surface 53, 54 having a fourth helix angle 55 is formed on each side.

For producing the gear green compact 43 in accordance with the sintered gear 1, at least the second helix angle 47 of at least one of the two toothed edge surfaces 45, 46 of the die 31 is unequal to the first helix angle of the helical toothing of the die 31. However, it is also possible for both toothed edge surfaces 45, 46 to have the same second helix angle 47 which is unequal to the first helix angle. It can moreover be provided that both toothed edge surfaces 45, 46 have a second helix angle 47 that is different from the first helix angle, wherein these two second helix angles 47, however, are different from one another. Moreover, it may be provided that one of the two toothed edge surfaces 45, 46 has a second helix angle 47 which is equal to the first helix angle, whereas the other one of the two toothed edge surfaces 45, 46 in any case has a second helix angle 47 that is unequal to the first helix angle. The shape of the inner surface of the die 31 bounding the die opening 42 is thus correspondingly designed to be inverse to the shape of the outer surface of the sintered gear 1.

The third helix angle 51 of the toothed edge surface 49, 50 of the lower stamp 32 and the fourth helix angle 55 of the toothed edge surfaces 53, 54 of the upper stamp 25 may be equivalent to the first helix angle of the helical toothings of the die 31, the lower stamp 32, and the upper stamp 25. The shapes of the outer surfaces of the lower stamp 32 and of the upper stamp 25 can therefore be equal (identical) to the shape of the outer surface of the sintered gear 1.

The shape of the end faces 4, 5 (FIG. 1) of the sintered gear 1 is produced by means of a corresponding shaping of the pressing surfaces of the upper stamp 25 and of the lower stamp 32.

It is therefore provided that at least one of the two toothed edge surfaces 45, 46 of the die has a second helix angle that is unequal to the first helix angle of the helical toothing. If the die 31 rotates clockwise, this is preferably the toothed edge surface 46 due to the helix direction of the helical toothing in FIG. 4 (can be gathered from the fact that only toothed surface 45 is visible). In case of a helical toothing with a different orientation and a counter-clockwise rotation of the die, this may also be the toothed edge surface 45.

In order to reduce the load on the toothed edge surface 46 and to better distribute the forces to further toothed edge surfaces 56 of the helical toothings of the compacting tool 4, it is provided that, in the embodiment variant of the helix direction of the helical toothing shown in FIG. 4, at least the toothed edge surface 46 is designed to be unequal to the first helix angle of the helical toothing.

Hence, at least the toothed edge surface 45 or 46 subjected to a higher load during the compaction of the metallic powder to form the gear green compact 43 generally has a second helix angle which is unequal to the first helix angle of the helical toothing of the die.

As described above regarding the sintered gear 1, according to a preferred embodiment variant, this second helix angle 47 is unequal to the first helix angle by a value which amounts to between 0.005° and 0.05°, in particular between 0.01° and 0.05°.

Figure 5:
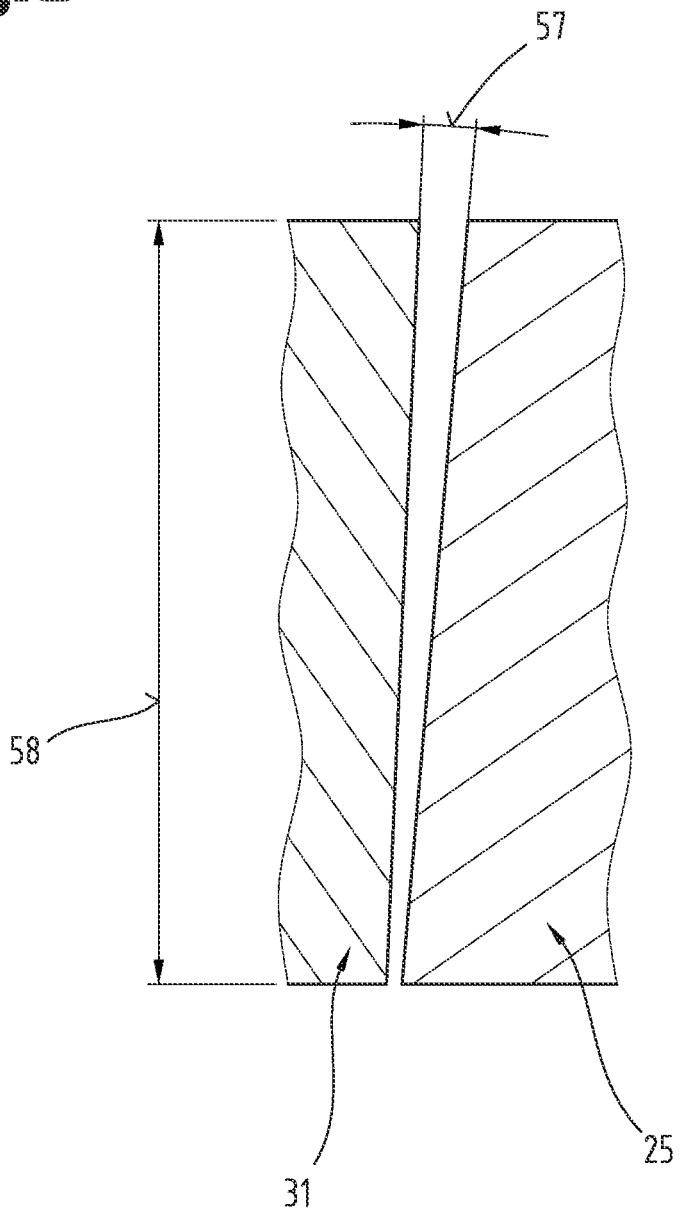
FIG. 5 shows a cutout from an embodiment variant of a device for producing a sintered gear in a side view.

According to a further embodiment variant, which can be seen better in FIG. 5, it may be provided that the difference between the second helix angle 47 and the first helix angle of the die 31 has a value which is calculated according to the formula INV SIN (RA/H), wherein RA refers to the maximum radial distance 57 between the die 31 and the lower stamp 32 or upper stamp 25 and H is a height 58 of the die 31, in each case given in mm. For the sake of simplicity, only the lower stamp 25 is shown in FIG. 5. Here, the maximum radial distance 57 is formed at the upper edge of the die 31. In this regard, the upper stamp 25 has a toothed edge surface 54 with a helix angle 55 (see FIG. 3), which corresponds to the helix angle 12 of the helical toothing 6 of the sintered gear 1 (see FIG. 1).

Generally, the second helix angle 47 of the die may be greater than its first helix angle. In the preferred embodiment variant, however, it may be provided that the second helix angle 47 of the die 31 is smaller than its first helix angle of the helical toothing. This embodiment variant position is also shown in FIG. 5. Thereby, it can be achieved that a placing of the upper stamp 25 and/or the lower stamp 32 on the die 31 in the lower region of the die 31 (as viewed across the height 58) is achieved. This has the advantage that the material above supports and tool breakage can be prevented. For example, at a height 58 of 70 mm, a change in angle of 0.0082°=0.01 mm deviation and/or of 0.0246°=0.03 mm deviation can be achieved.

According to a further embodiment variant, it may be provided that not only at least one of the toothed edge surfaces 45, 46 of the die 31 have a second helix angle 47 which is unequal to the first helix angle of the helical toothing of the die 31, but that at least one of the third helix angles 51 of the lower stamp 32 and/or at least one of the fourth helix angles 55 of the upper stamp 25 is unequal to the first helix angle of the helical toothing of the die 31. In this regard, as well, it may be provided according to embodiment variants that the third helix angle 51 of the lower stamp 32 and/or the fourth helix angle 55 of the upper stamp 25 is unequal to the first helix angle by a value amounting to between 0.005° and 0.05°, and/or that the difference between the third helix angle 51 of the lower stamp 32 and the first helix angle and/or the fourth helix angle 55 of the upper stamp 25 and the first helix angle has a value which is calculated according to the formula INV SIN (RA/H), wherein RA refers to the maximum radial distance 57 between the die 31 and the lower stamp 32 or upper stamp 25 and H is the height 58 of the die 31, in each case given in mm. In this regard, reference is made to the corresponding explanations above regarding the die 31.

For the same reasons mentioned above regarding the die 31, it may be provided according to a different embodiment variant that the third helix angle 51 of the lower stamp 32 and/or the fourth helix angle 55 of the upper stamp 25 is or are smaller than the first helix angle of the helical toothing of the die 31.

Provided that not only at least one toothed edge surface 45, 46 of the die 31 has a second helix angle 47 different from the first helix angle of the helical toothing of the die 31, according to a further embodiment variant, it may be provided that the third helix angle 51 of the lower stamp 32 and/or the fourth helix angle 55 of the upper stamp 25 is or are greater than the second helix angle 47 of the die 31. For example, the third helix angle 51 of the lower stamp 32 and/or the fourth helix angle 55 of the upper stamp 25 may be greater than the second helix angle 47 of the die 31 by a value selected from a range of 40 5 to 95% of the second helix angle 47 of the die 31.

According to a different embodiment variant, it may also be provided that the third helix angle 51 of the lower stamp 32 and/or the fourth helix angle 55 of the upper stamp 25 is formed only across a partial area of the height of the toothed edge surface 48, 49 or 53, 54, and that the remaining partial area of the height is formed having at least a helix angle different from the third helix angle 51 of the lower stamp 32 and/or from the fourth helix angle 55 of the upper stamp 25. The different helix angle may have a value which is, for example, between the second helix angle 47 of the helical toothing of the die 31 and the third helix angle 51 of the lower stamp 32 and/or the fourth helix angle 55 of the upper stamp 25. However, it may also be provided that the mentioned remaining partial area has a helix angle that is greater than the third helix angle 51 of the lower stamp 32 and/or the fourth helix angle 55 of the upper stamp 25.

It may also be provided that the second helix angle 47 of at least one of the toothed edge surfaces 45, 46 changes over the height 58 of the die, for example increases upwards.

According to an embodiment variant of the method, it may be provided that the extent of the absolute value of the deviation of the second helix angle 47 of at least one of the toothed edge surfaces 45, 46 from the first helix angle of the helical toothing of the die 31 is selected dependent on a pressure force at which the metallic powder is compacted to form the gear green compact 43, wherein $(p*S)/100{,}000=\Delta S$ applies, wherein p is the pressure force given in [MPa], S is the first helix angle given in [° ] and ΔS is the deviation from the first helix angle given in [° ]. This pressure force may, for example, amount to between 600 μm and 1200 μm.

The exemplary embodiments show and/or describe possible embodiment variants, while it should be noted at this point that combinations of the individual embodiment variants are also possible.

Finally, as a matter of form, it should be noted that for ease of understanding of the structure of sintered gear 1 or the device 21 for producing the gear green compact 43, these are not obligatorily depicted to scale.

Although only a few embodiments of the present invention have been shown and described, it is to be understood that many changes and modifications may be made thereunto without departing from the spirit and scope of the invention.

LIST OF REFERENCE NUMBERS

| | |
|---|---|
| 1 | Sintered gear |
| 2 | Gear body |
| 3 | Lateral surface |
| 4 | End face |
| 5 | End face |
| 6 | Helical toothing |
| 7 | Width |
| 8 | Width |
| 9 | Circumferential direction |
| 10 | Tooth |
| 11 | Axial direction |
| 12 | Helix angle |
| 13 | Toothed edge surface |
| 14 | Toothed edge surface |
| 15 | Web |
| 16 | Web |
| 17 | Plateau surface |
| 18 | Plateau surface |
| 19 | Helix angle |
| 20 | Ball ramp |
| 21 | Device |
| 22 | Lower stamp receptacle |
| 23 | Column |
| 24 | Compacting tool |
| 25 | Upper stamp |
| 26 | Upper stamp rotation element |
| 27 | Upper stamp rotation element |
| 28 | Upper stamp rotation element |
| 29 | Upper stamp rotation element |
| 30 | Die receptacle |
| 31 | Die |
| 32 | Lower stamp |
| 33 | Lower stamp support |
| 34 | Upper stamp receptacle |
| 35 | Upper stamp support |
| 36 | Bearing |
| 37 | End region |
| 38 | Upper stamp external toothing |
| 39 | End region |
| 40 | Lower stamp external toothing |
| 41 | Die internal toothing |
| 42 | Die opening |
| 43 | Gear green compact |
| 44 | Lateral surface |
| 45 | Toothed edge surface |
| 46 | Toothed edge surface |
| 47 | Helix angle |
| 48 | Lower stamp lateral surface |
| 49 | Toothed edge surface |
| 50 | Toothed edge surface |
| 51 | Helix angle |
| 52 | Upper stamp lateral surface |
| 53 | Toothed edge surface |
| 54 | Toothed edge surface |
| 55 | Helix angle |
| 56 | Toothed surface |
| 57 | Distance |
| 58 | Height |

What is claimed is:

1. A device (21) for producing a gear green compact (43) from a metallic powder, comprising a die (31) for receiving the metallic powder, an upper stamp (25) and a lower stamp (32), which are designed to be immersible into the die (31), wherein the die (31) has at least one helical toothing on an inner lateral surface (44), which helical toothing extends only over a partial area of the circumference of the inner lateral surface (44), and which has a first helix angle, wherein, adjoining the first helical toothing in a circumferential direction (9), one toothed edge surface (45, 46) is formed on each side, both of which have a second helix angle (47);

wherein the lower stamp (32) has a lower stamp helical toothing on an outer lower stamp lateral surface (48), which helical toothing extends only over a partial area of the circumference of the lower stamp lateral surface (48), and which has the first helix angle of the die (31), wherein, adjoining the helical toothing in a circumferential direction (9), one toothed edge surface (49, 50) is formed on each side, both of which have a third helix angle (51);

wherein upper stamp (25) has an upper stamp helical toothing on an outer upper stamp lateral surface (52), which helical toothing extends only over a partial area of the circumference of the upper stamp lateral surface (52), and which has the first helix angle of the helical toothing of the die (31), wherein, adjoining the helical toothing in a circumferential direction (9), one toothed edge surface (53, 54) is formed on each side, both of which have a fourth helix angle (55); and wherein at least one of the second helix angles (47) of the die (31) is unequal to the first helix angle of the helical toothing of the die (31).

2. The device (21) according to claim 1, wherein the second helix angle (47) of the die (31) is unequal to the first helix angle of the die (31) by a value amounting to between 0.005° and 0.05°.

3. The device (21) according to claim 1, wherein the difference between the second helix angle (47) and the first helix angle of the die (31) has a value which is calculated according to the formula INV SIN (RA/H), wherein RA refers to the maximum radial distance (57) between the die (31) and the lower stamp (32) or upper stamp (25) and H is a height (58) of the die, in each case given in mm.

4. The device (21) according to claim 1, wherein at least one of the third helix angles (51) of the lower stamp (32) and/or at least one of the fourth helix angles (55) of the upper stamp (25) is unequal to the first helix angle of the helical toothing of the die (31).

5. The device (21) according to claim 4, wherein the third helix angle (51) of the lower stamp (32) and/or the fourth helix angle (55) of the upper stamp (25) is unequal to the first helix angle by a value amounting to between 0.005° and 0.05°.

6. The device (21) according to claim 4, wherein the difference between the third helix angle (51) of the lower stamp (32) and the first helix angle and/or the fourth helix angle (55) of the upper stamp (25) and the first helix angle has a value which is calculated according to the formula INV SIN (RA/H), wherein RA refers to the maximum radial distance (57) between the die (31) and the lower stamp (32) or the upper stamp (25) and H is a height (58) of the die (31), in each case given in mm.

7. The device (21) according to claim 1, wherein the second helix angle (47) of the die (31) is smaller than the first helix angle of the helical toothing of the die (31).

8. The device (21) according to claim 4, wherein the third helix angle (51) of the lower stamp (32) and/or the fourth helix angle (55) of the upper stamp (25) is or are smaller than the first helix angle of the helical toothing of the die (31).

9. The device (21) according to claim 4, wherein the third helix angle (51) of the lower stamp (32) and/or the fourth helix angle (55) of the upper stamp (25) is or are greater than the second helix angle of the die (31).

10. The device (21) according to claim 4, wherein the third helix angle (51) of the lower stamp (32) and/or the fourth helix angle (55) of the upper stamp (25) is formed only across a partial area of the height of the toothed edge surface (48, 49 or 53, 54), and wherein the remaining partial area of the height is formed having at least a helix angle different from the third helix angle (47) of the lower stamp (32) and/or from the fourth helix angle (55) of the upper stamp (25).

11. A method for producing a sintered gear (1) comprising the steps:

providing a metallic powder;

pressing the powder to form a gear green compact (43);

possibly green machining the gear green compact (43); and sintering the gear green compact (43);

wherein the pressing of the powder to form a gear green compact (43) is carried out in a device (21) for producing the gear green compact (43) from the metallic powder, comprising a die (31) for receiving the metallic powder, an upper stamp (25) and a lower stamp (32), which are designed to be immersible into the die (31), wherein the die (31) has at least one helical toothing on an inner lateral surface (44), which helical toothing extends only over a partial area of the circumference of the inner lateral surface (44), and which has a first helix angle, wherein, adjoining the first helical toothing in a circumferential direction (9), one toothed edge surface (45, 46) is formed on each side, both of which have a second helix angle (47);

wherein the lower stamp (32) has a lower stamp helical toothing on an outer lower stamp lateral surface (48), which helical toothing extends only over a partial area of the circumference of the lower stamp lateral surface (48), and which has the first helix angle of the die (31), wherein, adjoining the helical toothing in a circumferential direction (9), one toothed edge surface (49, 50) is formed on each side, both of which have a third helix angle (51);

wherein upper stamp (25) has an upper stamp helical toothing on an outer upper stamp lateral surface (52), which helical toothing extends only over a partial area of the circumference of the upper stamp lateral surface (52), and which has the first helix angle of the helical toothing of the die (31), wherein, adjoining the helical toothing in a circumferential direction (9), one toothed edge surface (53, 54) is formed on each side, both of which have a fourth helix angle (55); and wherein at least one of the second helix angles (47) of the die (31) is unequal to the first helix angle of the helical toothing of the die (31).

12. The method according to claim 11, wherein the extent of the absolute value of the deviation of the second helix angle (47) of at least one of the toothed edge surfaces (45, 46) from the first helix angle of the helical toothing of the die (31) is selected dependent on a pressure force at which the metallic powder is compacted to form the gear green compact (43), wherein $(p*S)/100{,}000=\Delta S$ applies, wherein p is the pressure force given in [MPa], S is the first helix angle given in [° ] and ΔS is the deviation from the first helix angle given in [° ].

13. A sintered gear (1) comprising a gear body (2), which has a lateral surface (3) and two end faces (4, 5), wherein at least one helical toothing (6) is arranged on the lateral surface (3), which helical toothing (6) extends only over a partial area of the circumference of the gear body (2) and which has a first helix angle (12), and wherein, adjoining the helical toothing (6) in a circumferential direction (9), one toothed edge surface (12, 13) is formed on each side, both of which extend at a second helix angle (19) relative to the axial direction (11), wherein the second helix angle (19) of at least one of the toothed edge surfaces (12, 13) is unequal to the first helix angle (12) of the helical toothing (6).

14. The sintered gear according to claim 13, wherein the second helix angle (19) of the toothed edge surfaces (13, 14) is unequal to the first helix angle (12) by a value amounting to between 0.005° and 0.05°.

15. The sintered gear (1) according to claim 13, wherein the second helix angle (19) of the toothed edge surfaces (13, 14) is smaller than the first helix angle (12) of the helical toothing (6).

* * * * *